US008670701B2

(12) United States Patent
Miyamoto

(10) Patent No.: US 8,670,701 B2
(45) Date of Patent: Mar. 11, 2014

(54) ENDLESS BELT MEMBER, IMAGE FORMING APPARATUS, AND METHOD OF MANUFACTURING ENDLESS BELT MEMBER HAVING POSITION DETECTING MEMBER

(75) Inventor: Masahiko Miyamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 145 days.

(21) Appl. No.: 13/299,996

(22) Filed: Nov. 18, 2011

(65) Prior Publication Data

US 2012/0294633 A1 Nov. 22, 2012

(30) Foreign Application Priority Data

May 16, 2011 (JP) ..... 2011-109420

(51) Int. Cl.
*G03G 15/01* (2006.01)

(52) U.S. Cl.
USPC ..... 399/302; 399/301

(58) Field of Classification Search
USPC ..... 399/301, 302, 303, 116
See application file for complete search history.

(56) References Cited

U.S. PATENT DOCUMENTS

2004/0146321 A1* 7/2004 Kyung et al. ..... 399/301
2005/0286930 A1* 12/2005 Sawai et al. ..... 399/167

FOREIGN PATENT DOCUMENTS

JP A-11-316506 11/1999
JP 2003128292 A * 5/2003 ..... B65H 5/02
JP A-2005-024934 1/2005

* cited by examiner

*Primary Examiner* — Billy Lactaoen
(74) *Attorney, Agent, or Firm* — Oliff PLC

(57) ABSTRACT

An endless belt member for an image forming apparatus includes an endless belt member body that contains a resin and conductive particles, an inner transparent film, a position detection member that is used to detect the position of the endless belt member body, and an outer transparent film, wherein the position detection member is sealed by the inner and outer transparent films, is provided on a part of an outer peripheral surface of the endless belt member body, and has side surfaces which are substantially perpendicular to the outer peripheral surface of the endless belt member body, and the inner and outer transparent films are welded to each other at portions, which is adjoining the side surfaces of the position detection member, of the portions that come into direct contact with each other.

12 Claims, 5 Drawing Sheets

ENDLESS BELT MEMBER, IMAGE FORMING APPARATUS, AND METHOD OF MANUFACTURING ENDLESS BELT MEMBER HAVING POSITION DETECTING MEMBER

CROSS-REFERENCE TO RELATED APPLICATIONS

This application is based on and claims priority under 35 USC 119 from Japanese Patent Application No. 2011-109420 filed May 16, 2011.

BACKGROUND (i) Technical Field

The present invention relates to an endless belt member, an image forming apparatus, and a method of manufacturing an endless belt member.

(ii) Related Art

In an electrophotographic image forming apparatus, there is a method of recording an image by directly transferring a toner image formed on an image holding member to a recording medium transported by a recording medium transporting belt member or a method of recording an image by transferring a toner image to a recording medium after temporarily transferring the toner image to an intermediate transfer belt member.

Various methods are proposed as a method of detecting the positions of the recording medium transporting belt member and the intermediate transfer belt member.

SUMMARY

According to an aspect of the invention, there is an endless belt member for an image forming apparatus including:

an endless belt member body that contains a resin and conductive particles;

an inner transparent film;

a position detection member that is used to detect the position of the endless belt member body; and an outer transparent film, wherein the position detection member is sealed by the inner and outer transparent films, is provided on a part of an outer peripheral surface of the endless belt member body, and has side surfaces which are substantially perpendicular to the outer peripheral surface of the endless belt member body, and the inner and outer transparent films are welded to each other at portions, which is adjoining the side surfaces of the position detection member, of the portions that come into direct contact with each other.

BRIEF DESCRIPTION OF THE DRAWINGS

Exemplary embodiments of the present invention will be described in detail based on the following figures, wherein.

DETAILED DESCRIPTION

Embodiments of the invention will be described in detail below.

<Endless Belt Member>

An endless belt member for an image forming apparatus according to this embodiment (hereinafter, simply referred to as a "belt member") includes an endless belt member body (hereinafter, simply referred to as a "belt member body") and a position detection film. The belt member body contains at least a resin and conductive particles. The position detection film is provided on a part of the outer peripheral surface of the belt member body, is interposed and sealed by an inner transparent film and an outer transparent film, and is used to detect the position of the belt member body. A portion of the inner transparent film that does not face the inner surface of the position detection film comes into direct contact with a portion of the outer transparent film that does not face the outer surface of the position detection film; and the inner and outer transparent films are welded to each other at portions, which face the side surfaces of the position detection film, of the portions that come into direct contact with each other.

Figure 2:
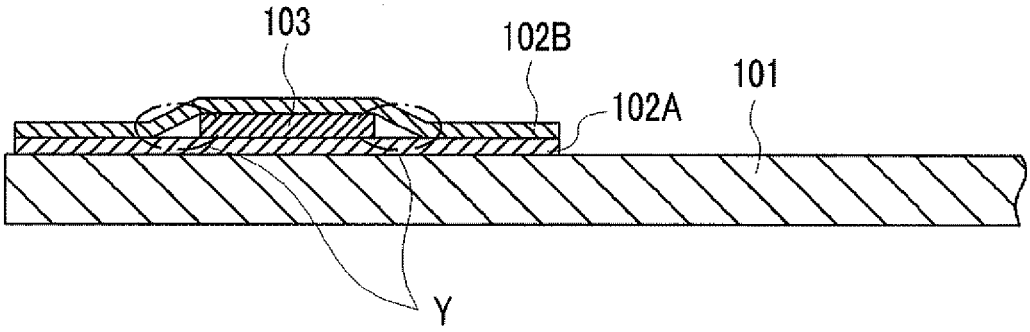
FIG. 2 is a cross-sectional view of a portion, which includes a position detection film, of a belt member in the related art.

As shown in FIG. 2, when a position detection film 103 is provided on a belt member body 101, the position detection film 103 adheres to inner and outer transparent films 102A and 102B while being interposed between the inner and outer transparent films 102A and 102B for the purpose of protection. Accordingly, the position detection film 103 may be provided on the belt member body 101 while being sealed. However, due to the thickness of the position detection film 103, gaps are formed at the portions, which face the side surfaces of the position detection film 103, (portions covering the side surfaces of the position detection film 103) Y of the portions of the inner and outer transparent films 102A and 102B that come into direct contact with each other. If image formation is repeated for a long time on a belt member where the gaps are formed, toner penetrates the gaps. As a result, toner further penetrates the interfaces of the position detection film 103 and the outer transparent film 102B and the surfaces of the position detection film 103 are contaminated, so that detection failure occurs.

Figure 1:
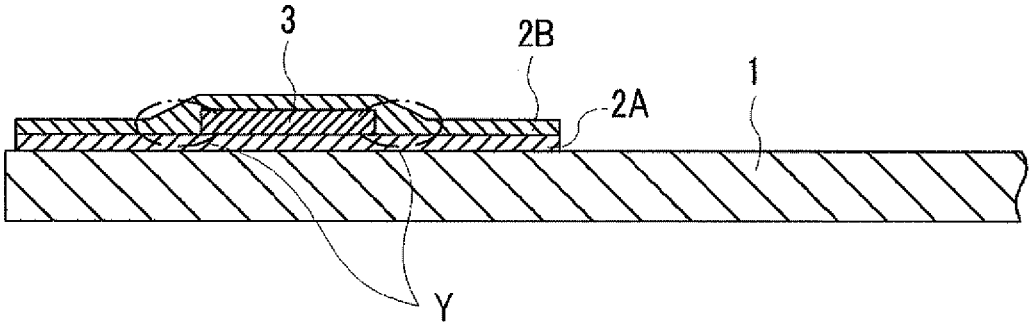
FIG. 1 is a cross-sectional view of a portion, which includes a position detection film, of a belt member according to an embodiment.

In contrast, in the belt member according to this embodiment, as shown in FIG. 1, a portion of an inner transparent film 2A that does not face the inner surface of a position detection film 3 comes into direct contact with a portion of an outer transparent film 2B that does not face the outer surface of the position detection film 3; and the inner and outer transparent films 2A and 2B are welded to each other at portions Y, which face the side surfaces of the position detection film 3, of the portions that come into direct contact with each other. Accordingly, gaps formed at the side portions of the position detection film 3 are suppressed, so that the penetration of toner into the gaps or the interfaces of the position detection film 3 and the outer transparent film 2B is suppressed. As a result, the deterioration of position detection accuracy, which is caused by repeated use, is suppressed.

Meanwhile, it is possible to visually check whether the inner and outer transparent films 2A and 2B are welded to each other. More specifically, when the portions Y, which face the side surfaces of the position detection film 3, (the peripheral portions of the position detection film 3) of the portions of the inner and outer transparent films 2A and 2B coming into direct contact with each other are visually observed, whether the inner and outer transparent films are welded to each other is determined depending on whether welding traces formed by heat or pressure applied from the outside are checked.

Further, FIG. 1 is a cross-sectional view of a portion, which includes the position detection film 3, of the belt member according to this embodiment. In FIG. 1, the left-right direction represents the axial direction of the belt member and the back-front direction represents the circumferential direction of the belt member.

Here, it is preferable that the position of the position detection film 3 on the belt member according to this embodiment be the end of the belt member body 1 in the axial direction (the left-right direction in FIG. 1) particularly when the belt member is used as an intermediate transfer belt member, a recording medium transporting belt member, or the like in an image forming apparatus. More specifically, it is preferable that a belt member used as an intermediate transfer belt member include the position detection film 3 in an area (end portion) thereof where a toner image is not transferred from an image holding member. Further, is preferable that a belt member used as a recording medium transporting belt member include the position detection film 3 in an area (end portion) thereof where a recording medium is not supported.

However, the belt member according to this embodiment is not limited to thereto, and the position detection film 3 may be provided at a position other than the end portion of the belt member according to the use of the belt member.

Furthermore, the position detection film 3 may be provided at one portion or plural portions on the belt member according to this embodiment in the circumferential direction (rotational drive direction) of the belt member.

[Surface Roughness Ra]

Moreover, in the belt member according to this embodiment, it is preferable that the surface roughness Ra of the outer surface of the welded portion of the outer transparent film be 5 μm or less.

When the belt member according to this embodiment is applied to a position detecting method of detecting the position of a position detection film by radiating light to the position detection film and reading the light reflected from the position detection film, the diffuse reflection of the light, which is radiated to the position detection film to detect the position of the position detection film, is suppressed since the surface roughness of the outer surface of the welded portion is suppressed to 5 μm or less. As a result, position detection accuracy is improved.

Meanwhile, the surface roughness Ra is measured by a method disclosed in JIS B0601-2001. The numerical values disclosed in this specification are measured by this method.

It is more preferable that the surface roughness Ra be 3.5 μm or less.

[Method of Manufacturing Belt Member]

An example of a method of manufacturing the belt member according to this embodiment will be described.

First, the surface, which has adhesion layer, of the inner transparent film 2A of which one surface has adhesion layer is attached to the belt member body 1; the surface, which has adhesion layer, of the position detection film 3 of which one surface has adhesion layer is attached onto the inner transparent film 2A attached onto the belt member body 1; and the surface, which has adhesion layer, of the outer transparent film 2B of which one surface has adhesion layer is attached to the surface of the inner transparent film 2A that includes the position detection film 3. Accordingly, a transparent film-position detection film laminate where the position detection film 3 is sealed by the inner and outer transparent films 2A and 2B is formed on the belt member body 1.

Meanwhile, a continuous transparent film functioning as both the inner and outer transparent films 2A and 2B may be used. That is, a part of the surface, which has adhesion layer, of a transparent film (functioning as both the inner transparent film 2A and the outer transparent film 2B) of which one surface has adhesion layer is attached to the belt member body 1; and the surface, which has adhesion layer, of the position detection film 3 of which one surface has adhesion layer is attached onto a portion of the transparent film that is attached to the belt member body 1. In addition, the transparent film is circumferentially attached to the belt member body 1 and is attached so as to be laminated on the position detection film 3 attached onto the transparent film, so that a transparent film-position detection film laminate where the position detection film 3 is interposed and sealed by the continuous transparent film functioning as both the inner and outer transparent films 2A and 2B may be formed.

Then, the portions Y, which face the side surfaces of the position detection film 3, (the peripheral portions of the position detection film 3) of the portions of the inner and outer transparent films 2A and 2B coming into direct contact with each other are welded to each other, so that a belt member is manufactured.

Here, welding using heating, welding using ultrasonic radiation and the like are used as a method of welding the inner and outer transparent films 2A and 2B, and the method is selected according to the material of the transparent film to be used.

In the case of the welding using ultrasonic radiation, for example, the head of an ultrasonic radiation device is pressed against a portion on the outer transparent film 2B to be welded and radiates ultrasonic waves, so that the welding is performed. Further, in the case of the welding using heating, for example, the head of a heating device is pressed against a portion on the outer transparent film 2B to be welded and heats the portion on the outer transparent film 2B to be welded, so that the welding is performed.

Meanwhile, the surface roughness Ra of the outer surface of the welded portion of the outer transparent film is adjusted by controlling, for example, the shape of the head of the ultrasonic radiation device or the head of the heating device that is pressed at the time of welding, the pressing pressure of the head, the time of ultrasonic radiation or heating, or the like.

[Position Detection Film]

For example, a reflective film applied to a position detecting method, which reflects the light emitted from a detection unit (position detecting sensor) provided in the image forming apparatus and makes the position detecting sensor read the reflected light, may be used as the position detection film 3.

A material of which the optical characteristic (light reflection characteristic or the like) is different from the optical characteristic of the belt member body is used as a material of the reflective film. For example, examples of the reflective film include a metal film and a metal-deposited resin film. Examples of the metal film include an aluminum film, a stainless-steel film, and a copper film. Further, examples of metal for the metal-deposited resin film include aluminum, silver, and copper; and examples of a resin for the metal-deposited resin film include polycarbonate, PET, polyester, and polyarylate.

Meanwhile, a film of which one surface has been previously subjected to adhesion treatment may be used as the position detection film 3, and examples of the position detection film 3 include Trade name: Rivic Tape No. 401 silver manufactured by Nitta Denko Corporation and Trade name: MYRAP No. 602 manufactured by Nichiban Co., Ltd. as articles on the market.

[Transparent Film]

The inner and outer transparent films 2A and 2B function to seal the position detection film 3 to protect the position detection film 3.

For example, examples of the materials of these transparent films include polycarbonate, PET, polyester, and polyarylate. Among them, polyester is particularly preferable.

Meanwhile, a film of which one surface has been previously subjected to adhesion treatment may be used as these transparent films, and examples of the transparent films include Trade name: No. 31B manufactured by Nitto Denko Corporation and Trade name: No. 5511 manufactured by Nichiban Co., Ltd. as articles on the market and the like.

Further, a continuous transparent film functioning as both the inner and outer transparent films 2A and 2B may be used as already described.

[Adhesive]

Then, an adhesive may be used for the adhesion between the inner transparent film 2A and the position detection film 3, the adhesion between the outer transparent film 2B and the position detection film 3, the adhesion between the inner and outer transparent films 2A and 2B, the adhesion between the inner transparent film 2A and the belt member body 1, and the like.

An acrylic adhesive, a polyether adhesive, a silicone adhesive, a rubber adhesive, and the like, which are known, may be used as the adhesive without particular limitation.

Meanwhile, when the adhesive is used, a primer (sealer) may be used in order to improve the adhesive property of the surface of an adherend.

The kind of the applied primer varies according to the material of the adherend. However, the primers known in the related art, for example, a polyurethane primer, an acrylic primer, a polyether primer, a silicone primer, a rubber primer, and the like may be used.

[Belt Member Body]

Resin

At least a resin is used for the belt member body 1. Resins, which are used for the belt member of the image forming apparatus without particular limitation, such as a polyether resin, a polyamide resin, a polycarbonate resin, a polysulfone resin, a polyethersulfone resin, a polyimide resin, and a polyamide-imide resin, may be used as the resin. Among them, a polyimide resin and a polyamide-imide resin are most preferable. Meanwhile, the resins may be used alone or may be used in the form of a mixture.

Conductive Particle

Conductive particles are contained in the belt member body 1 in terms of conductivity (that is, in the range having volume resistivity of $10^9$ Ω·cm to $10^{14}$ Ω·cm).

For example, examples of conductive particles include carbon black, an ion-conductive resin, and a conductive polymer material. In particular, carbon black is preferably used. For example, examples of the carbon black include oil furnace black, channel black, and acetylene black. Among them, channel black is particularly preferable. Meanwhile, the conductive materials may be used alone or may be used in the form of a mixture.

Other Additives Other than the above-mentioned materials, various additives, which are used in the belt member of the image forming apparatus, such as an antioxidant and a surfactant, may be used in the belt member body 1.

Method of Manufacturing Belt Member Body

Figure 3:
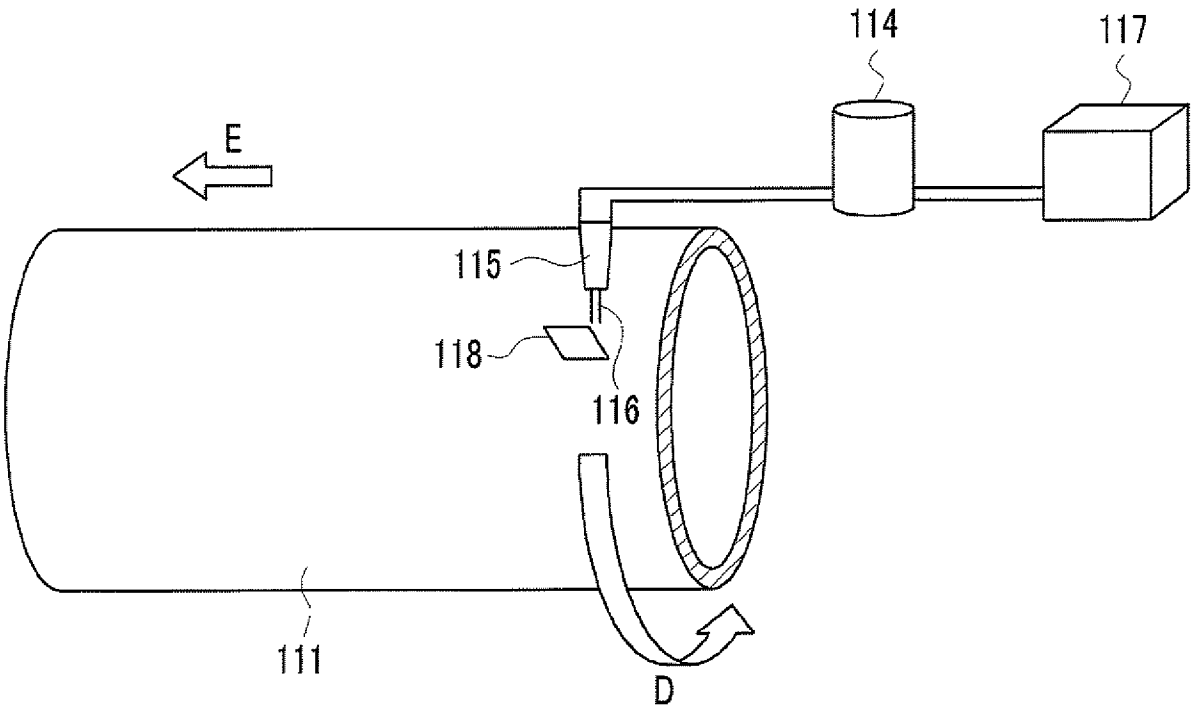
FIG. 3 is a view showing the schematic configuration of an apparatus that manufactures a belt member body by a spin-coating method (flow coating method)

A method of manufacturing the belt member body 1 will be described as an example of a method using the spin-coating method (flow coating method) shown in FIG. 3.

A cylinder forming pipe 111, which has an outer diameter corresponding to the length of a belt member body, is prepared in a spin-coating method. A nozzle 115 for ejecting coating liquid 116 (coating liquid containing at least the resin and the conductive particles), which is used to form the belt member body, to the outer peripheral surface of the cylinder forming pipe 111 is disposed at a position along the outer peripheral surface of the cylinder forming pipe 111. The nozzle 115 is connected to a coating liquid container 114 through a pipe, and the coating liquid container 114 is connected to a pressure device 117 through a pipe. Further, a blade 118, which presses the ejected coating liquid 116 against the outer peripheral surface of the cylinder forming pipe 111, is disposed below the nozzle 115.

The cylinder forming pipe 111 is rotated in the rotation direction (arrow D) of the cylinder forming pipe, the coating liquid 116 is ejected from the nozzle 115 onto the outer peripheral surface of the cylinder forming pipe 111, and the coating liquid is leveled on the outer peripheral surface of the cylinder forming pipe 111 by the blade 118. The nozzle 115 and the blade 118 are moved in the moving direction (arrow E) of the nozzle and the blade, and the coating liquid 116 is coated on the outer peripheral surface of the cylinder forming pipe 111. Meanwhile, the coating liquid 116 is adjusted so as to be ejected from the nozzle 115 by the pressure device 117. Accordingly, a coated film of the coating liquid 116 is formed on the outer peripheral surface of the cylinder forming pipe 111.

Then, after a belt member body is formed by the heating and drying of the coated film of the coating liquid 116, the belt member body is cooled, separated from the cylinder forming pipe 111, and cut to a predetermined width, so that the belt member body is obtained.

For example, a polyimide precursor is used as a resin material of the coating liquid (resin solution) 116. In this case, after a coated film of the coating liquid 116 is formed on the outer peripheral surface of the cylinder forming pipe 111, a solvent is removed by drying the coated film at a temperature of 80° C. to 170° C. (drying process) and is converted to an imide by heating the coated film at a temperature of 250° C. to 350° C. (burning process), so that a polyimide resin film is formed.

It is preferable that the thickness of the belt member body obtained in this way be in the range of 50 mm to 150 μm particularly when the belt member body is used as a recording medium transporting belt member or an intermediate transfer belt member of an image forming apparatus.

Further, another layer, such as a surface protective layer or a resistance adjusting layer, may be provided on the inner peripheral surface or the outer peripheral surface of the belt member body.

<Image Forming Apparatus>

Next, the image forming apparatus will be described. In particular, the above-mentioned belt member according to this embodiment is preferably used as an intermediate transfer belt member or a recording medium transporting belt member of an image forming apparatus.

Here, as an image forming apparatus where the belt member is applied as an intermediate transfer belt member, there is an image forming apparatus including: an image holding member; a charging device that charges the image holding member; a latent image forming device that forms an electrostatic latent image by exposing the surface of the charged image holding member; a developing device that forms a toner image by developing the electrostatic latent image with toner; an intermediate transfer belt member that is formed of the above-mentioned belt member according to this embodiment; a primary transfer unit that transfers the toner image formed on the image holding member to the surface of the intermediate transfer belt member; a secondary transfer unit that transfers the toner image having been transferred to the intermediate transfer belt member to a recording medium; and a detection unit that detects the position of the position detection film of the intermediate transfer belt member.

Further, as an image forming apparatus where the belt member is applied as a recording medium transporting belt member, there is an image forming apparatus including: an image holding member; a charging device that charges the image holding member; a latent image forming device that forms an electrostatic latent image by exposing the surface of the charged image holding member; a developing device that forms a toner image by developing the electrostatic latent image with toner; a recording medium transporting belt member that is formed of the above-mentioned belt member according to this embodiment; a transfer unit that transfers the toner image formed on the image holding member to a recording medium transported by the recording medium transporting belt member; and a detection unit that detects the position of the position detection film of the recording medium transporting belt member.

Next, the image forming apparatus according to this embodiment will be described with reference to drawings.

Figure 4:
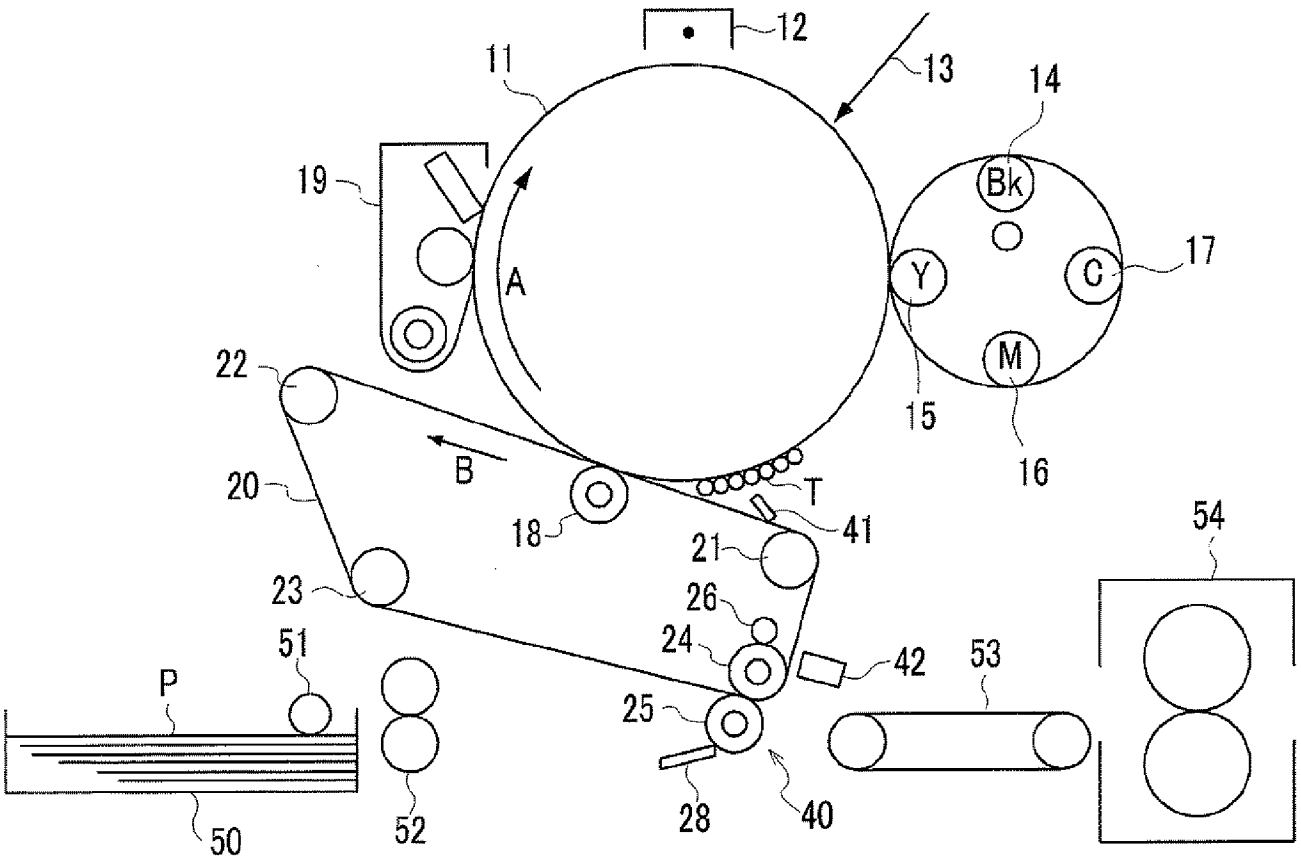
FIG. 4 is a view showing the schematic configuration of an image forming apparatus according to an embodiment.

FIG. 4 is a view showing the schematic configuration of an image forming apparatus that can form multicolored images. In FIG. 4, as a photoconductor drum (image holding member) 11 is rotated in the direction of an arrow A, an electrostatic latent image according to image information is formed on the surface of the photoconductor drum by a well-known electrophotographic process of a charging device 12 and an exposure device (not shown) (an exposure beam is denoted by reference numeral 13 in FIG. 4). Further, a rotary developer unit, which includes a black (Bk) developer unit 14, a yellow (Y) developer unit 15, a magenta (M) developer unit 16, and a cyan (C) developer unit 17, is disposed on the photoconductor drum 11. An electrostatic latent image formed on the photoconductor drum 11 is developed with each color and transferred to an intermediate transfer belt member (intermediate transfer belt) 20. This is repeated for the respective colors, so that multicolored images are formed on the intermediate transfer belt member.

Further, the intermediate transfer belt member (intermediate transfer belt) 20, which is disposed so as to come into contact with the surface of the photoconductor drum 11, is stretched by plural (four in this aspect) rollers 21 to 24, forms a belt member stretching device, and is disposed so as to be capable of being rotationally driven in the direction of an arrow B. Here, in this aspect, reference numeral 21 denotes a driving roller of the intermediate transfer belt 20, reference numeral 22 denotes a driven roller, reference numeral 23 denotes a supporting roller that controls the tension intermediate transfer belt 20 so that the tension intermediate transfer belt is constant, and reference numeral 24 denotes a counter roller for secondary transfer. In this aspect, the above-mentioned belt member according to this embodiment is used as the intermediate transfer belt 20.

Moreover, a primary transfer unit (primary transfer roller in this aspect) 18 is disposed at a portion (primary transfer position) of the intermediate transfer belt 20, which faces the photoconductor drum 11, on the back surface of the intermediate transfer belt 20. A voltage, which has a polarity opposite to the charging polarity of toner, is applied to the primary transfer roller 18, so that toner images T formed on the photoconductor drum 11 are electrostatically attracted to the intermediate transfer belt 20.

Further, a secondary transfer unit 40 is disposed at a secondary transfer position of the intermediate transfer belt 20 that faces the transport path of a sheet P as a recording medium. A secondary transfer roller 25 and a counter roller 24 are provided in this aspect. The secondary transfer roller 25 is disposed so as to come into contact with the toner image supporting surface (outer peripheral surface) of the intermediate transfer belt 20. The counter roller 24 is disposed on the inner peripheral surface of the intermediate transfer belt 20 and forms a counter electrode of the secondary transfer roller 25. Further, in this aspect, the secondary transfer roller 25 is grounded and a bias having the same polarity as the charging polarity of toner is applied to the counter roller 24 through a power supply roller 26. Meanwhile, the secondary transfer roller 25 is provided with a cleaning blade 28 made of, for example, urethane rubber.

In this aspect, for example, the counter roller 24 has a foamed elastic layer and a conductive layer on the outer periphery of a metal core member in this order, and these layers are made of EPDM. The conductive layer, which is provided on the outside, is made of semi-conductive EPDM (ethylene propylene diene rubber) foamed rubber where carbon black is dispersed. Further, the secondary transfer roller 25 has a core layer and a surface layer on the outer periphery of a metal core member in this order, the core layer is fixed around the core and made of a foamed EPDM material where carbon black is dispersed, and the surface layer is formed with a fluorine resin material where carbon black is dispersed.

Furthermore, a belt cleaner (cleaning scraper) 41, which removes toner remaining on the intermediate transfer belt 20, is provided on the downstream side of the secondary transfer unit 40.

Moreover, a detection unit (position detecting sensor) 42, which detects the position of the position detection film of the intermediate transfer belt 20, is provided on the downstream side of the secondary transfer unit 40 of the intermediate transfer belt 20 and on the upstream side of a cleaning scraper 41 so as to face the outer peripheral surface (toner image supporting surface) of the intermediate transfer belt 20.

Further, a sheet transporting system of this aspect feeds a sheet P from a sheet storage unit 50 by a feed roller 51; feeds the sheet P to a secondary transfer position at a predetermined timing after temporarily positioning and stopping the sheet by a registration roller 52; guides the sheet P, which has been subjected to secondary transfer, to a transport belt 53 through a sheet transport guide (not shown); and transports the sheet P to a fixing unit 54 by the transport belt 53.

[Detection Unit]

Here, the detection unit (position detecting sensor) 42 will be described with reference to the drawing.

Figure 5:
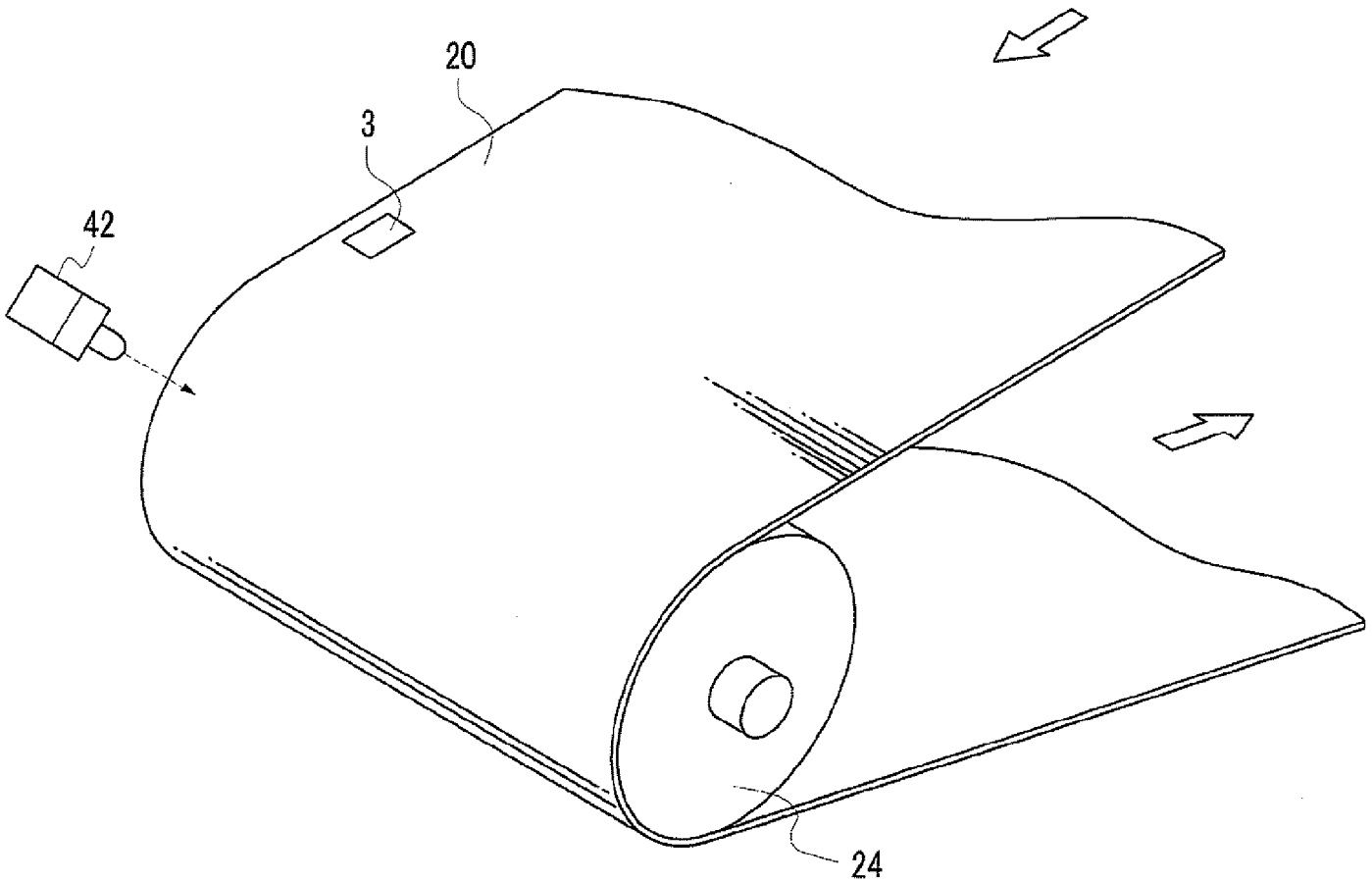
FIG. 5 is an enlarged view showing the schematic configuration of a portion, which includes a detection unit (position detecting sensor), of the image forming apparatus according to this embodiment.

The position detection film 3 is provided at an end portion of the intermediate transfer belt 20 shown in FIG. 5 in the axial direction, that is, in a non-image area of the outer peripheral surface of the intermediate transfer belt where images are not formed. Meanwhile, in FIG. 5, only the position detection film 3 is shown and the inner and outer transparent films 2A and 2B and the like are not shown.

As the intermediate transfer belt 20 is rotated, the position detection film 3 is moved. The detection unit (position detecting sensor) 42, which detects the passage of the position detection film 3, is provided so as to face the moving position detection film 3. For example, a method, which emits light to the intermediate transfer belt 20, reads the light reflected from the intermediate transfer belt, and detects a position by the difference in reflection of light between a portion where the position detection film 3 is provided and a portion where the position detection film is not provided, is used for the detection unit 42. Specifically, a unit, which is a light receiving element and radiates laser light or LED light and detects the position of the rotating intermediate transfer belt 20 by detecting the passage of the position detection film 3 by a difference between the amount of light reflected from the position detection film 3 and the amount of light reflected from a portion where the position detection film 3 is not provided, may be applied as the detection unit 42.

Further, a controller (not shown) controls the transfer timing of the toner images T shown in FIG. 4 on the basis of the detection data detected by the detection unit 42, so that the toner images are exactly superimposed.

Next, an image forming process of the image forming apparatus according to this aspect will be described.

When a start switch (not shown) is turned on, an image forming process is performed. Specifically, if an electrostatic latent image written on the photoconductor drum 11 corresponds to, for example, the information of a yellow image, this electrostatic latent image is developed by a developer unit 15 storing yellow (Y) toner. Accordingly, a yellow toner image T is formed on the photoconductor drum 11. An unfixed toner image T formed on the photoconductor drum 11 is transferred to the surface of the intermediate transfer belt 20 from the photoconductor drum 11 at the primary transfer position where the photoconductor drum 11 and the intermediate transfer belt 20 come into contact with each other.

In this case, when a monochrome image is to be formed, the toner image T primarily transferred to the intermediate transfer belt 20 is secondarily transferred to a sheet P. However, when a color image where plural color toner images are superimposed is to be formed, a process for forming a toner image on the photoconductor drum 11 and a process for primarily transferring the toner image T is repeated for the respective colors. For example, when a multicolored image where four color toner images are superimposed is to be formed, each of the black, yellow, magenta, and cyan toner images T is formed on the photoconductor drum 11 at the time of one rotation of the photoconductor drum. These toner images T are sequentially primarily transferred to the intermediate transfer belt 20. Meanwhile, the intermediate transfer belt 20 is rotationally driven with the same cycle as the cycle of the photoconductor drum 11 while supporting the black toner image T, which has been primarily transferred first. Each of the yellow, magenta, and cyan toner images T is transferred to the intermediate transfer belt 20 at the time of one rotation of the photoconductor drum.

The toner images T, which have been primarily transferred to the intermediate transfer belt 20 in this way, are transported to the secondary transfer position as the intermediate transfer belt 20 is rotationally driven. Meanwhile, a sheet P is fed to the secondary transfer position at a timing determined by the registration roller 52, and the secondary transfer roller 25 nips the sheet P together with the counter roller 24. Accordingly, the toner images T supported by the intermediate transfer belt 20 are electrostatically transferred to the sheet P at the secondary transfer position by the action of a transfer electric field generated in an area (nip area) interposed between the counter roller 24 and the secondary transfer roller 25 that is the secondary transfer unit 40. After that, the sheet P, which has been subjected to secondary transfer, is transported to the fixing unit 54 through the transport belt 53, so that the toner images T on the sheet P are fixed.

Meanwhile, the timing of the transfer of the unfixed toner images T to the intermediate transfer belt 20 is controlled on the basis of detection data about the position of the intermediate transfer belt 20 that is detected by the detection unit 42, so that the toner images are exactly superimposed.

EXAMPLES

The invention will be described below using Examples and Comparative Examples, but is not limited to the following examples.

Example 1

Manufacture of Belt Member

The following belt member is manufactured as follows: the belt member includes a position detection film 3, which is interposed and sealed by a transparent film functioning as both inner and outer transparent films 2A and 2B, on the outer peripheral surface of an belt member body 1; and portions Y, which face the side surfaces of a position detection film 3, of portions of the inner and outer transparent films 2A and 2B coming into direct contact with each other are welded to each other.

Meanwhile, the respective parts of the belt member are as follows:

- Belt member body 1: a belt made of a polyimide resin where carbon black is dispersed (ϕ168 mm and width of 364.8 mm)
- Transparent film: trade name No. 31B manufactured by Nitto Denko Corporation
- Position detection film 3: trade name Rivic Tape No. 401 silver manufactured by Nitto Denko Corporation First, a part of the surface, which has adhesion layer, of the transparent film of which one surface has adhesion layer is attached to the belt member body 1; and the surface, which has adhesion layer, of the position detection film 3 of which one surface has adhesion layer is attached onto a portion of the transparent film that is attached to the belt member body 1. In addition, the transparent film is circumferentially attached to the belt member body 1 and is attached so as to be laminated on the position detection film 3 attached onto the transparent film. In this way, there is obtained a belt member including the position detection film 3 (transparent film-position detection film laminate) that is interposed and sealed by the continuous transparent film functioning as both the inner and outer transparent films 2A and 2B.

Then, the head of an ultrasonic device (trade name: USWP-200Z28S-S, manufactured by NIPPON CHOONPA KOGYO KK) is pressed against the portions Y, which face the side surfaces of the position detection film 3, (the peripheral portion of the position detection film 3) of the portions of the inner and outer transparent films 2A and 2B coming into direct contact with each other and welds the inner and outer transparent films 2A and 2B by radiating ultrasonic waves, so that the belt member is manufactured.

Meanwhile, it is visually checked that the portions Y, which face the side surfaces of the position detection film 3, (the peripheral portion of the position detection film 3) of the portions of the inner and outer transparent films 2A and 2B coming into direct contact with each other are welded to each other, and it is checked that no gap is formed at the portions Y facing the side surfaces of the position detection film 3.

The surface roughness Ra of the outer surface of the welded portion of the outer transparent film 2B of the obtained belt member is measured by the above-mentioned method, and Ra is 3.2 μm.

Example 2

A belt member is manufactured by the same method as the method described in Example 1 except that the surface roughness Ra of the outer surface of the welded portion of the outer transparent film 2B is adjusted to 5.3 μm by controlling pressure at the time of pressing of the head of the ultrasonic device and the time of ultrasonic radiation in Example 1.

Meanwhile, it is visually checked that the portions Y, which face the side surfaces of the position detection film 3, (the peripheral portion of the position detection film 3) of the portions of the inner and outer transparent films 2A and 2B coming into direct contact with each other are welded to each other, and it is checked that no gap is formed at the portions Y facing the side surfaces of the position detection film 3.

Comparative Example 1

A belt member (an aspect shown in FIG. 2) where portions Y, which face the side surfaces of a position detection film 103, of portions of inner and outer transparent films 102A and 102B coming into direct contact with each other are not welded to each other is manufactured by the same method as the method described in Example 1 except that ultrasonic waves are not radiated by an ultrasonic device in Example 1.

Meanwhile, gaps are formed at the portions Y facing the side surfaces of the position detection film 103.

Comparative Example 2

Manufacture of Belt Member

Figure 6:
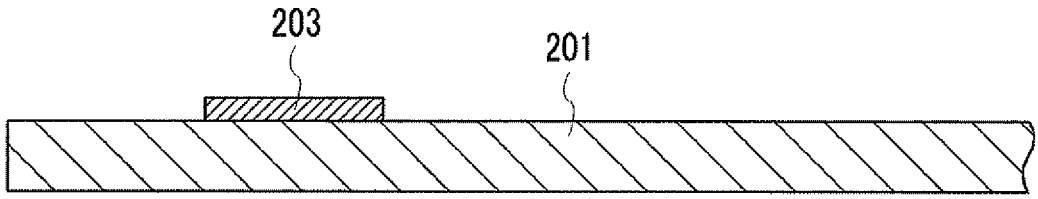
FIG. 6 is a cross-sectional view of a portion, which includes a position detection film, of a belt member that is manufactured in the Comparative Example.

As shown in FIG. 6, the position detection film 203 (of which one surface is subjected to adhesion treatment) used in Example 1 is attached to the end portion of the outer peripheral surface of the belt member body 201, which is used in Example 1, in the axial direction, so that a belt member is manufactured.

<Evaluation Test>

Each of the belt members obtained in the above-mentioned Examples and Comparative Examples is mounted as an intermediate transfer belt member in an apparatus, that is, DocuColor 1257 (manufactured by Fuji Xerox Co., Ltd.) that is modified so as to be capable of adjusting the light output of a position detecting sensor, as an image forming apparatus that includes one image holding member (photoconductor) and an intermediate transfer belt member and uses a method (so-called four-cycle method) of forming a color image on the intermediate transfer belt member by repeating the formation of a toner image on the image holding member and the transfer of the toner image to the intermediate transfer belt member for four colors, that is, cyan (C), magenta (M), yellow (Y), and black (Bk). Images are formed (printed) on 20,000 sheets by using A3 sheets (J sheets, manufactured by Fuji Xerox Co., Ltd.), and the following evaluation is performed.

Meanwhile, the light output of the position detecting sensor provided in the image forming apparatus is adjusted by a voltage of a power source that is used to emit light.

—Evaluation of Penetration of Toner—

The portions, which face the side surfaces of the position detection film, (the peripheral portions of the position detection film) of the portions of the belt member where the inner and outer transparent films 2A and 2B come into direct contact with each other, and the outer surface of the position detection film (the surface reflecting the light of the position detecting sensor) are visually observed (the outer surface of the position detection film is observed in the case of the belt member of Comparative Example 2) after the printing of 20,000 sheets, and the occurrence of contamination caused by toner is evaluated. Evaluation criteria are as follows:

○: Contamination does not occur.

X: Contamination occurs due to the penetration of toner.

—Evaluation of Position Detection Accuracy—

The accuracy of the position detection of the intermediate transfer belt member is evaluated at the beginning of the printing of 20,000 sheets and after the printing of 20,000 sheets. Evaluation criteria are as follows:

○: Excellent detection (that is, sufficient amount of reflected light is obtained by a position detection film)

Δ: Excellent detection is achieved by the adjustment of the light output of a position detecting sensor (that is, sufficient amount of reflected light is obtained by a position detection film when the light output is adjusted)

X: detection failure (that is, sufficient amount of reflected light is not obtained by a position detection film even though the light output is adjusted)

TABLE 1

| | Welded portion Ra [μm] | Penetration of toner | Position detection accuracy: Light output [Voltage V] | Position detection accuracy: Beginning | Position detection accuracy: After printing of 20,000 sheets | Note |
|---|---|---|---|---|---|---|
| Example 1 | 3.2 μm | ○ | 7.0 | ○ | ○ | |
| Example 2 | 5.3 μm | ○ | 8.0 | Δ | Δ | (*1) |
| Comparative Example 1 | (Not measured) | X | 8.0 | ○ | X | |
| Comparative Example 2 | (Not measured) | X | 8.0 | ○ | X | (*2) |

(*1) Minor diffuse reflection of light occurs at a portion where a transparent film is welded.
(*2) Peeling of a position detection film occurs.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An endless belt member for an image forming apparatus comprising:

an endless belt member body that contains a resin and conductive particles;

an inner transparent film;

a position detection member that is used to detect the position of the endless belt member body; and an outer transparent film, wherein the position detection member is sealed by the inner and outer transparent films, is provided on a part of an outer peripheral surface of the endless belt member body, and has side surfaces which are substantially perpendicular to the outer peripheral surface of the endless belt member body, the inner and outer transparent films are welded to each other at portions, which is adjoining the side surfaces of the position detection member, of the portions that come into direct contact with each other, and a surface roughness Ra of the outer surface of the welded portion of the outer transparent film is 5 μm or less.

2. The endless belt member for an image forming apparatus according to claim 1, wherein the endless belt member is an intermediate transfer belt member.

3. The endless belt member for an image forming apparatus according to claim 2, wherein the part of the outer peripheral surface of the endless belt member is an area to which a toner image is not transferred.

4. The endless belt member for an image forming apparatus according to claim 1, wherein the endless belt member is a recording medium transporting belt member.

5. The endless belt member for an image forming apparatus according to claim 4, wherein the part of the outer peripheral surface of the endless belt member is an area that does not support a recording medium.

6. An endless belt member for an image forming apparatus comprising:

an endless belt member body that contains a resin and conductive particles;

an inner transparent film;

a position detection member that is used to detect the position of the endless belt member body; and an outer transparent film, wherein the position detection member is sealed by the inner and outer transparent films, is provided on a part of the outer peripheral surface of the endless belt member body, and has side surfaces in a direction perpendicular to the outer peripheral surface, a portion of the inner transparent film, which does not come into contact with the position detection member, comes into direct contact with a portion of the outer transparent film that does not come into contact with the position detection member, a gap is not formed at portions, which face the side surfaces of the position detection member, of the portions that come into direct contact with each other, and a surface roughness Ra of the outer surface of the welded portion of the outer transparent film is 5 μm or less.

7. An image forming apparatus comprising:

an image holding member;

a charging device that charges the image holding member;

a latent image forming device that forms an electrostatic latent image by exposing the surface of the charged image holding member;

a developing device that forms a toner image by developing the electrostatic latent image with toner;

an intermediate transfer belt member that is formed of the endless belt member according to claim 1;

a primary transfer unit that transfers the toner image formed on the image holding member to the surface of the intermediate transfer belt member;

a secondary transfer unit that transfers the toner image transferred to the intermediate transfer belt member to a recording medium; and a detection unit that detects the position of the position detection member of the intermediate transfer belt member.

8. The image forming apparatus according to claim 7, further comprising:

the intermediate transfer belt member where the part of the outer peripheral surface of the endless belt member is an area to which the toner image is not transferred.

9. An image forming apparatus comprising:

an image holding member;

a charging device that charges the image holding member;

a latent image forming device that forms an electrostatic latent image by exposing the surface of the charged image holding member;

a developing device that forms a toner image by developing the electrostatic latent image with toner;

a recording medium transporting belt member that is formed of the endless belt member according to claim 1;

a transfer unit that transfers the toner image formed on the image holding member to a recording medium transported by the recording medium transporting belt member; and a detection unit that detects the position of the position detection member of the recording medium transporting belt member.

10. The image forming apparatus according to claim 9, further comprising:

the recording medium transporting belt member where the part of the outer peripheral surface of the endless belt member is an area that does not support the recording medium.

11. An image forming apparatus comprising:

an image holding member;

a charging device that charges the image holding member;

a latent image forming device that forms an electrostatic latent image by exposing the surface of the charged image holding member;

a developing device that forms a toner image by developing the electrostatic latent image with toner;

an intermediate transfer belt member that is formed of the endless belt member according to claim 6;

a primary transfer unit that transfers the toner image formed on the image holding member to the surface of the intermediate transfer belt member;

a secondary transfer unit that transfers the toner image transferred to the intermediate transfer belt member to a recording medium; and a detection unit that detects the position of the position detection member of the intermediate transfer belt member.

12. A method of manufacturing an endless belt member, the method comprising:

forming an endless belt that contains a resin and conductive particles;

making an inner transparent film, a position detection member that is used to detect the position of the endless belt member body, and an outer transparent film adhere to the endless belt; and welding the inner transparent film and the outer transparent film to portions of the endless belt facing side surfaces, which are substantially perpendicular to the outer peripheral surface of the belt, of the position detection member, wherein a surface roughness Ra of the outer surface of the welded portion of the outer transparent film is 5 μm or less.

* * * * *